US007059823B2

(12) United States Patent
Sakaguchi et al.

(10) Patent No.: US 7,059,823 B2
(45) Date of Patent: Jun. 13, 2006

(54) MOLECULAR PUMP EQUIPPED WITH FLANGE HAVING BUFFERING PORTION

(75) Inventors: Yoshiyuki Sakaguchi, Narashino (JP); Satoshi Okudera, Narashino (JP); Hirotaka Namiki, Narashino (JP); Takashi Kabasawa, Narashino (JP); Togru Miwata, Narashino (JP)

(73) Assignee: BOC Edwards Technologies Limited, Narashino-Shi (JP)

( * ) Notice: Subject to any disclaimer, the term of this patent is extended or adjusted under 35 U.S.C. 154(b) by 116 days.

(21) Appl. No.: 10/685,713

(22) Filed: Oct. 15, 2003

(65) Prior Publication Data

US 2004/0081569 A1 Apr. 29, 2004

(30) Foreign Application Priority Data

Oct. 23, 2002 (JP) ..... 2002-308829
Aug. 20, 2003 (JP) ..... 2003-296803

(51) Int. Cl.
*F04D 29/64* (2006.01)

(52) U.S. Cl. ..... 415/9; 415/90; 415/213.1; 417/423.4

(58) Field of Classification Search ..... 415/9, 415/90, 119, 213.1; 417/423.4
See application file for complete search history.

(56) References Cited

U.S. PATENT DOCUMENTS 4,086,012 A 4/1978 Buckley et al. ..... 403/2
6,485,254 B1 * 11/2002 Davis ..... 415/90
2002/0172589 A1 * 11/2002 Yamashita et al. ..... 415/90

FOREIGN PATENT DOCUMENTS

EP 1258634 11/2002
EP 1312804 5/2003
EP 1314892 5/2003

OTHER PUBLICATIONS

PATENT ABSTRACTS of JAPAN, vol. 1996, No. 09, Sep. 30, 1996, publication No. 08114196, publication date May 7, 1996.

* cited by examiner

*Primary Examiner*—Edward K. Look
*Assistant Examiner*—Richard A. Edgar
(74) *Attorney, Agent, or Firm*—Adams & Wilks

(57) ABSTRACT

A molecular pump has a casing having a gas inlet port and a gas discharge port, a stator disposed within the casing, a shaft disposed in the casing concentrically with the stator, a bearing rotatably supporting the shaft for undergoing rotation relative to the stator in a preselected direction of rotation, a rotor mounted on the shaft for rotation therewith in the preselected direction of rotation, and a motor for rotationally driving the shaft. A flange is connected to the casing at the gas inlet port. The flange has at least one mounting hole for receiving a fastener, a first elongated through-hole disposed in communication with the mounting hole, and a second elongated through-hole spaced apart from the first elongated through-hole in a direction toward a direction of rotation opposite to the preselected direction of rotation to define between the first and second elongated through-holes a deformable thin-wall portion for undergoing deformation due to a shock resulting from a torque acting on the casing in the preselected direction of rotation.

20 Claims, 13 Drawing Sheets

THICKNESS T OF FLANGE

PRIOR ART

MOLECULAR PUMP EQUIPPED WITH FLANGE HAVING BUFFERING PORTION

BACKGROUND OF THE INVENTION

1. Field of the Invention

The present invention relates to a molecular pump and, more particularly, to a turbo-molecular pump which is used for evacuating a vacuum vessel, for example.

2. Description of the Related Art

Molecular pumps such as turbo-molecular pumps and screw groove pumps are frequently used to evacuate vacuum vessels such as a semiconductor manufacturing system and an electron microscope which require high vacuum.

These molecular pumps have inlet ports provided with flanges adapted to be fixed to evacuating ports of vacuum vessels such as by bolts, respectively. An O-ring or gasket is interposed between the flange and the evacuating port of the vacuum vessel so as to keep air tightness between the molecular pump and the evacuating port.

Inside the molecular pump, there are provided a rotor section which is pivotally supported so as to be rotatable and which can be rotated at a high speed by a motor section, and a stator section fixed to a casing of the molecular pump.

In the molecular pump, the rotor section rotates at a high speed so that the rotor section and the stator section exhibit an evacuating effect. By this evacuating effect, a gas is sucked from the gas inlet port of the molecular pump and exhausted from a gas discharge port.

Usually, the molecular pump exhausts a gas in a molecular flow range (a range in which a vacuum degree is high so that the frequency of collision among molecules is low). To exhibit an evacuating ability in the molecular flow range, the rotor section is required to rotate at a high speed such as on the order of 30,000 revolutions per minute.

Meanwhile, in a case where some trouble has occurred during operation of the molecular pump so that the rotor section has collided with the stator section and the other fixed members within the molecular pump, the angular momentum of the rotor section is transmitted to the stator section, fixed members and the like so that a larger torque is instantly generated which rotates the entire molecular pump in a rotating direction of the rotor section. This torque also exerts a large stress to the vacuum vessel through the flange.

Thereupon, the following techniques have been proposed to mitigate such a shock.

[Patent-Related Reference 1] JP-A-1998-274189

[Patent-Related Reference 2] JP-A-1996-114196

Both of the techniques proposed in the patent-related reference 1 and the patent-related reference 2 are to provide a buffering mechanism at a flange disposed at a gas inlet port of a turbo-molecular pump.

FIG. 23 a flange having the buffering mechanism as proposed in the patent-related reference 1.

In FIG. 23, a flange 201 is provided at a gas inlet port of the turbo-molecular pump. The flange 201 is provided with a plurality of bolt holes 203 in elongated hole shapes on the same circle along an arc of the flange 201 and concentrically therewith. Contrary, the flange at the vacuum vessel side has the same outer diameter and inner diameter as the flange 201, and is provided with bolt holes in normal shapes (having cylindrical inner peripheral surfaces) arranged on the same circle concentrically with the flange itself at the vacuum vessel side.

The flange 201 and the flange at the vacuum vessel side are concentrically aligned with each other, the bolts 202 are then inserted through the bolt holes of them, respectively, and nuts are threadedly fitted over these bolts and then tightened, so that the turbo-molecular pump is fixed to the vacuum vessel.

Upon mounting the turbo-molecular pump onto the vacuum vessel, the bolts 202 are to be fixed at the ends of the bolt holes 203 in the rotation direction of the rotor. Then, in the case of a torque being generated which rotates the turbo-molecular pump in the rotation direction of the rotor when the rotor section is broken and touches the stator section and the like, the flange 201 slides (slips) in the rotation direction of the rotor so that the shock caused by the torque in the turbo-molecular pump can be buffered.

Further, the patent-related reference 1 also discloses a technique where each bolt hole (of circular cross section) of the flange 201 is formed to be sufficiently larger than the outer diameter of the bolt 202, and a buffering material is interposed between the bolt 202 and bolt hole 203.

The patent-related reference 2 describes a technique for absorbing the torque caused in the turbo-molecular pump by breakage of the rotor section and the like, by plastically deforming the bolts for joining the turbo-molecular pump to the vacuum vessel into an elbowed shape.

To plastically deform the bolts in the above manner, the bolt holes of the flange at the turbo-molecular pump side are formed into elongated hole shapes in the rotation direction of the rotor, and a thin plate portion in a pawl shape for deforming the bolt into the elbowed shape is formed near a bottom of each elongated hole.

When the structure for absorbing a shock by the flange portion of the turbo-molecular pump is used identically to the techniques disclosed in the patent-related references 1, 2, the safety of the turbo-molecular pump is enhanced. Further, the mounting strength between the flange portion of the turbo-molecular pump and the flange portion of the vacuum vessel side can be then reduced as compared with a case of absence of such a buffering mechanism (i.e., when the absorbing mechanism is absent, it is required to enhance the mechanical strength of the mounting portions so as to withstand an occurring torque, and required to enhance the mounting strength), and the manufacturing cost, working cost and the like can be reduced.

However, the patent-related reference 1 describing the bolt holes 203 formed into the elongated hole shapes presents a problem of complicated positioning (phasing) of the bolts on the installing job site. Also, there is a disadvantage that the shock-absorbing properties are changed depending on the tightening state of the bolts. Further, there is a problem of an increased cost, in case of using a buffering material.

Further, in the technique described in the patent-related reference 2, the shock-absorbing properties are changed depending on the natures (material, rigidity, property relative to shearing stress, and the like) of bolts to be used. It is thus desirable to specify a bolt for mounting, in case of guaranteeing a predetermined shock-absorbing property. Unfortunately, many kinds of bolts having the same shapes and different natures are distributed, so that the distribution, mounting and the like of turbo-molecular pumps are complicated in case of specifying the combination of turbo-molecular pump and bolts which are members different from each other. Also, when bolts of types different from specified ones are used, the used bolts are likely to rupture so that the turbo-molecular pump is dropped away from the vacuum vessel. Moreover, there is another problem of an increased machining cost, due to the thin plate portion in the pawl shape machined in the elongated hole.

SUMMARY OF THE INVENTION

Accordingly, an object of the present invention is to provide a molecular pump having an inexpensive and stable buffering mechanism that achieves shock-absorbing properties.

To achieve the above object, the present invention of a first aspect provides a molecular pump including a cylindrical casing which is provided with a gas inlet port and a gas discharge port; a stator which is formed within the casing; a shaft which is disposed concentrically with the stator; a bearing which rotatably supports the shaft so as to be rotatable relative to the stator; a rotor which is mounted on the shaft and rotates integrally with the shaft; a motor which drives and rotates the shaft; and a flange portion which is provided at the gas inlet port side of the casing and is provided with a buffering portion to be deformed by a shock due to a torque acting on the casing in the rotation direction of the rotor.

To achieve the above object, in the invention of a second aspect, the flange portion is provided with a plurality of bolt holes for fixing the flange portion; and the buffering portion is provided with a thin-wall portion provided adjacently to the bolt hole in a direction opposite to the rotation direction of the rotor.

To achieve the above object, in the invention of a third aspect, the thin-wall portion comprises a cutout section formed in an axial direction of the bolt hole.

To achieve the above object, in the invention of a fourth aspect, the buffering portion is constituted by an elongated hole section having a width which is directed in the radial direction of the rotor and is changed along the rotation direction of the rotor.

To achieve the above object, in the invention of a fifth aspect, the elongated hole section is provided with a positioning portion for positioning a bolt.

To achieve the above object, the invention of a sixth aspect provides a flange for connecting a gas inlet port of a molecular pump to an evacuating port of a vacuum vessel, wherein the flange includes a plurality of bolt holes for fixing the flange, and a thin-wall portion provided adjacently to the bolt hole in the rotation direction of a rotor.

To achieve the above object, in the invention of a seventh aspect, the flange portion is provided with a plurality of bolt holes for fixing the flange portion, and the buffering portion includes a thin-wall portion in a flat plate shape provided adjacently to the bolt hole in a direction opposite to the rotation direction of the rotor, and a through hole formed apart from the bolt hole in the direction opposite to the rotation direction of the rotor and via the thin-wall portion.

To achieve the above object, in the invention of an eighth aspect, the bolt hole is provided with a guiding portion for guiding a bolt inserted through the bolt hole toward a center of the thin-wall portion.

To achieve the above object, in the invention of a ninth aspect, the thin-wall portion has a plastic deformation strength lower than a rupture strength of a bolt inserted through the bolt hole.

To achieve the above object, in the invention of a tenth aspect, the thin-wall portion has a plastic deformation strength lower than a rupture strength of a bolt inserted through the bolt hole. It is enough for the plastic deformation strength that the plastic deformation strength in the direction opposite to the rotation direction of a rotor is lower than the rupture strength of the bolt.

To achieve the above object, in the invention of an eleventh aspect, the molecular pump further includes a washer interposed between a bolt-head of a bolt inserted through the bolt hole and the flange portion, and a portion at least touching the flange portion is existent in a region of the washer between the center of the bolt and a washer end in the rotation direction of the rotor, at a position where the bolt has been moved in the direction of the thin-wall portion by a shock caused by collision of the rotor.

To achieve the above object, in the invention of a twelfth aspect, the molecular pump further includes a washer interposed between a bolt-head of a bolt inserted through the bolt hole and the flange portion, and a portion at least touching the flange portion is existent in a region of the washer between the center of the bolt and a washer end in the rotation direction of the rotor, at a position where the bolt has been moved in the direction of the thin-wall portion by a shock caused by collision of the rotor.

To achieve the above object, in the invention of a thirteenth aspect, the molecular pump further includes a washer interposed between a bolt-head of a bolt inserted through the bolt hole and the flange portion, and a portion at least touching the flange portion is existent in a region of the washer between the center of the bolt and a washer end in the rotation direction of the rotor, at a position where the bolt has been moved in the direction of the thin-wall portion by a shock caused by collision of the rotor.

To achieve the above object, in the invention of a fourteenth aspect, the molecular pump further includes a washer interposed between a bolt-head of a bolt inserted through the bolt hole and the flange portion, and a portion at least touching the flange portion is existent in a region of the washer between the center of the bolt and a washer end in the rotation direction of the rotor, at a position where the bolt has been moved in the direction of the thin-wall portion by a shock caused by collision of the rotor.

According to the present invention, a molecular pump having an inexpensive and stable buffering mechanism that achieves shock-absorbing properties can be provided.

DETAILED DESCRIPTION OF THE PREFERRED EMBODIMENTS

Preferred embodiments of the present invention will now be described in detail with reference to FIG. 1 through FIG. 16.

(1) Summary of Embodiments

In the embodiments of the present invention, a thin-wall portion is provided at a position confronting with each bolt mounting hole of a flange in a direction opposite to the rotation direction of a rotor. In a case where a shock to the whole of the molecular pump is caused by a torque due to touching a rotor section with a stator section or the like, the thin-wall portion is plastically deformed so that the energy for rotating the molecular pump is absorbed.

Figure 3:
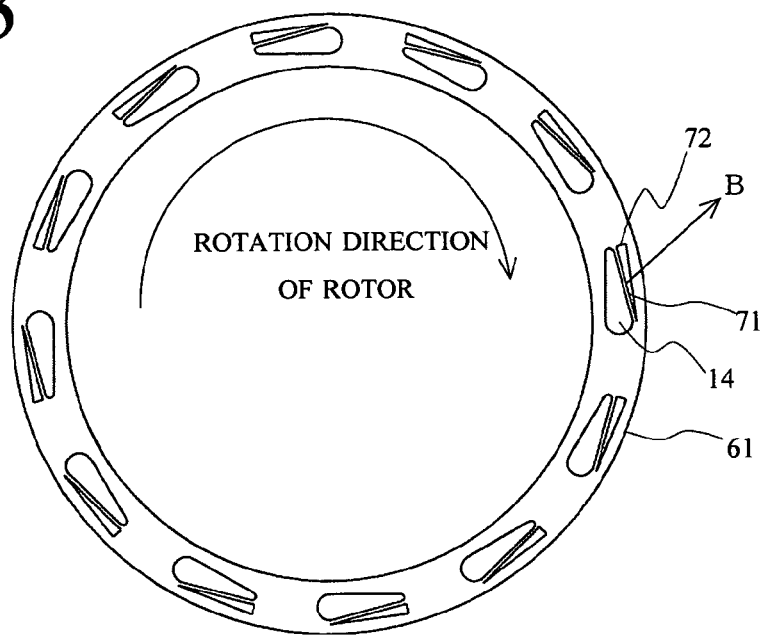
FIG. 3 is a view showing a flange of the molecular pump viewed from a gas inlet port side.

The forming patterns of the thin-wall portion are variously conceivable, and it is possible to provide a cavity portion 72 adjacent to each bolt hole 14 in a flange 61 of FIG. 3, for example. The cavity portion 72 is a through hole penetrating the flange 61. Thereby, a thin-wall portion 71 is formed between the bolt hole 14 and the cavity portion 72.

If a shock in the rotation direction of a rotor section is caused by rotor section breakage, etc., the flange 61 slides in the rotation direction of rotor section together with the molecular pump. Then a bolt that fixes the flange 61 to a flange of a vacuum vessel hits the thin-wall portion 71, so that the thin-wall portion 71 is plastically deformed in the direction of arrow B. Thus, by the plastic deformation of the thin-wall portion 71, energy for rotating the molecular pump is consumed as energy for plastically deforming the thin-wall portion 71, so that the shock caused by the molecular pump is buffered.

(2) Details of Embodiments

Figure 1:
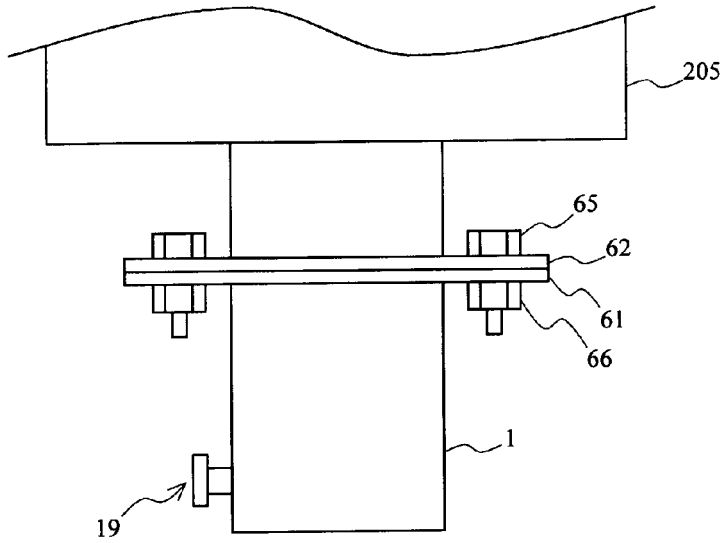
FIG. 1 is a view showing an example of configuration for mounting a molecular pump of an embodiment in accordance with the present invention to a vacuum vessel.

FIG. 1 is a view showing an example of a configuration for mounting a molecular pump 1 of an embodiment in accordance with the present invention to a vacuum vessel 205.

The molecular pump 1 is a vacuum pump which exhibits an evacuating effect by a rotor section rotating at a high speed and a fixed stator section, and which is a turbo-molecular pump, screw groove pump, or one having both structures of them.

The molecular pump 1 has a gas inlet port provided with a flange 61, and is provided with a gas discharge port 19 at an exhausting side.

The vacuum vessel 205 constitutes a vacuum system such as a semiconductor manufacturing system or a mirror barrel of electron microscope, and is provided with a flange 62 at an evacuating port.

The flanges 61, 62 are provided with pluralities of bolt holes formed on the same positions on the same circle, respectively, concentrically with these flanges. Then bolts 65 are inserted through these bolt holes and nuts 66 are threadedly fitted over these bolts 65 and tightened, so that the molecular pump 1 is mounted and fixed to a lower portion of the vacuum vessel 205. The gas within the vacuum vessel 205 is sucked from the gas inlet port of the molecular pump 1, and exhausted from the gas discharge port 19. Thereby, reaction gas or other gases for manufacturing semiconductors can be evacuated from the vacuum vessel 205.

Although the molecular pump 1 is mounted to the lower portion of the vacuum vessel 205 in such a shape for hanging the molecular pump from the vacuum vessel 205 in the illustrated embodiment, the mounting position of the molecular pump 1 is not limited thereto, and it is possible to horizontally lay the molecular pump 1 and mount the same to the side portion of the vacuum vessel 205, or to make the molecular pump 1 upside-down and to mount the gas inlet port thereof to the upper portion of the vacuum vessel 205.

Further, a valve for regulating a flow rate of an evacuated gas may be provided between the evacuating port of the vacuum vessel 205 and the gas inlet port of the molecular pump 1.

Generally, the gas discharge port 19 is connected to a roughing vacuum pump such as a rotary pump.

Figure 2:
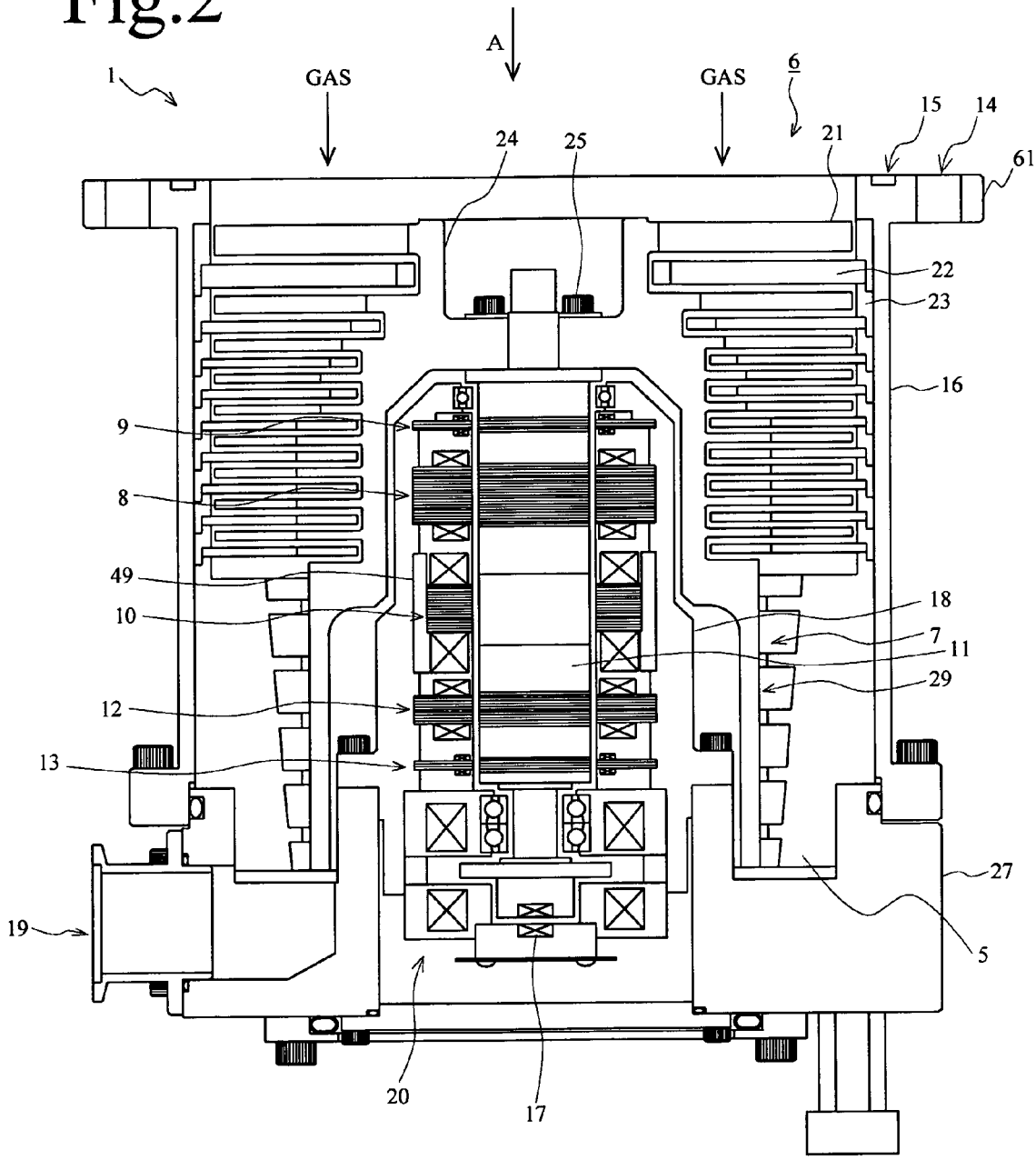
FIG. 2 is a sectional view of the molecular pump of the embodiment of the present invention, showing a cross section in the axial direction.

FIG. 2 is a sectional view of the molecular pump 1 of the embodiment of the present invention, showing a cross section in the axial direction.

In this embodiment of the present invention, a molecular pump of a so-called hybrid vane type will be explained as an example, which comprises a turbo-molecular pump section and a screw groove pump section.

A casing 16 constituting an armoring body of the molecular pump 1 is in a cylindrical shape, and constitutes a frame of the molecular pump 1 together with a disk-shaped base 27 provided at a bottom of the casing 16. Structures for causing the molecular pump 1 to exhibit an evacuating function are housed within the casing 16.

The structures exhibiting the evacuating function are generally constituted by a rotor section 24 pivotally supported so as to be rotatable and a stator section fixed to the casing 16. From a standpoint of a pump type, a gas inlet port 6 side is constituted by a turbo-molecular pump section, and the gas discharge port 19 side is constituted by a screw groove pump section.

The rotor section 24 is constituted by rotor vanes 21 provided at the gas inlet port 6 (turbo-molecular pump section) side, a cylindrical member 29 provided at the gas discharge port 19 (screw groove pump section) side, and a shaft 11 and the like. Each rotor vane 21 is constituted by blades installed to radially extend from the shaft 11 so as to be inclined through a predetermined angle from a plane perpendicular to the axis of the shaft 11, and these rotor vanes 21 are formed in a plurality of stages in the axial direction of the turbo-molecular pump section.

The cylindrical member 29 is a member having an outer peripheral surface in a cylindrical shape, and constitutes the rotor section 24 of the screw groove pump section.

The shaft 11 is a columnar member constituting an axis of the rotor section 24, and a component comprising the rotor vanes 21 and cylindrical member 29 is screwed to an upper end of the shaft 11 by bolts 25.

A permanent magnet is fixed to an outer peripheral surface of the shaft 11 at a substantially central portion in the axial direction, and constitute a rotor of a motor section 10. The magnetic poles around an outer periphery of the shaft 11 formed by this permanent magnet are an N pole over a half circumference of the outer peripheral surface and an S pole over the remaining half circumference.

Further, those portions of magnetic bearing portions 8, 12 at the rotor section 24 side which pivotally support the shaft 11 in the radial direction are formed at the gas inlet port 6 side and gas discharge port 19 side relative to the motor section 10 of the shaft 11, and a portion of a magnetic bearing portion 20 at the rotor section 24 side which pivotally supports the shaft 11 in the axial direction (thrust direction) is formed at a lower end of the shaft 11.

Those portions at the rotor side of displacement sensors 9, 13 are formed near the magnetic bearing portions 8, 12, respectively, so as to detect a displacement of the shaft 11 in the radial direction.

Those portions of the magnetic bearing portions 8, 12 and displacement sensors 9, 13 at the rotor side are constituted by steel plates laminated in the rotational axial direction of the rotor section 24. This is to prevent occurrence of eddy current in the shaft 11 due to magnetic fields generated by coils constituting those portions of the magnetic bearing portions 8, 12 and displacement sensors 9, 13 at the stator side.

The rotor section 24 as described above is formed of a metal such as stainless steel or aluminum alloy.

The stator section is formed at an inner periphery side of the casing 16. This stator section is constituted by stator vanes 22 provided at the gas inlet port 6 (turbo-molecular pump section) side, a screw groove spacer 5 provided at the gas discharge port 19 (screw groove pump) side, and the like.

Each stator vane 22 is constituted by blades extending from the inner peripheral surface of the casing 16 toward the shaft 11 so as to be inclined through a predetermined angle from a plane perpendicular to the axis of the shaft 11, and these stator vanes 22 are formed in a plurality of stages in the axial direction of the turbo-molecular pump section alternately with the rotor vanes 21. The stator vanes 22 at the stages are separated from one another by spacers 23 in cylindrical shapes.

The screw groove spacer 5 is a columnar member having an inner surface provided with spiral grooves 7. The inner peripheral surface of the screw groove spacer is opposed to an outer peripheral surface of the cylindrical member 29 with a predetermined clearance (gap). The direction of the spiral groove 7 formed on the screw groove spacer 5 is directed toward the gas discharge port 19 when a gas is transferred within the spiral groove 7 in the rotation direction of the rotor section 24. The depth of the spiral groove 7 becomes shallower toward the gas discharge port 19, so that the gas transferred within the spiral groove 7 is more compressed as the gas approaches the gas discharge port 19.

The stator section is formed of a metal such as stainless steel or aluminum alloy.

The base 27 is a disk-shaped member, and a stator column 18 in a cylindrical shape concentrical with the rotational axis of the rotor is mounted at a radial center of the base 27 in the direction of the gas inlet port 6.

The stator column 18 supports those portions of the motor section 10, magnetic bearing portions 8, 12, and displacement sensors 9, 13 at the stator side.

In the motor section 10, stator coils of a predetermined number of poles are equidistantly disposed on the inner periphery side of the stator, so that a rotating magnetic field can be generated around the magnetic poles formed at the shaft 11. Further, a collar 49 which is a cylindrical member formed of a metal such as stainless steel is disposed at the outer periphery of the stator coils, so as to protect the motor section 10.

The magnetic bearing portions 8, 12 are constituted by coils arranged at 90° intervals around the rotation axis. Further, the magnetic bearing portions 8, 12 attract the shaft 11 by the magnetic fields generated by these coils, so as to magnetically levitate the shaft 11 in the radial direction.

The magnetic bearing portion 20 is formed at the bottom of the stator column 18. The magnetic bearing portion 20 is constituted by a disk protruded from the shaft 11 and coils disposed above and under the disk, respectively. The magnetic fields generated by these coils attract the disk so that the shaft 11 is magnetically levitated in the radial direction.

The gas inlet port 6 of the casing 16 is provided with the flange 61 protruded toward the outer periphery side of the casing 16. The flange 61 is provided with the bolt holes 14 for inserting the bolts 65 therethrough, respectively, and a groove 15 for fitting therein an O-ring for holding air tightness relative to the flange 62 at the vacuum vessel 205 side. The flange 61 is provided with a mechanism for buffering a shock to be caused by the molecular pump 1 in the rotation direction of the rotor section 24. This mechanism will be described later in detail.

The molecular pump 1 constituted in the above manner operates as follows, so as to evacuate a gas from the vacuum vessel 205.

Firstly, the magnetic bearing portions 8, 12, 20 magnetically levitate the shaft 11, so that the rotor section 24 is pivotally supported in a space in a non-touching manner.

Next, the motor section 10 operates so as to rotate the rotor in a predetermined direction. The rotational speed is on the order of 30,000 revolutions per minute, for example. In the embodiment of the present invention, the rotation direction of the rotor section 24 is a clockwise direction when viewed in a direction of arrow A in FIG. 2. It is also possible to constitute the molecular pump 1 so as to rotate in the counterclockwise direction.

When the rotor section 24 rotates, the gas is sucked from the gas inlet port 6 by the action of the rotor vanes 21 and stator vanes 22, and is compressed as the gas advances to the lower stages.

The gas compressed at the turbo-molecular pump section is further compressed at the screw groove pump section, and is exhausted from the gas discharge port 19.

FIG. 3 is a view showing the flange 61 viewed from the direction of arrow A in FIG. 2. To simplify the view, the groove 15 of the O-ring and the internal structure of the molecular pump 1 are not shown.

As shown, the flange 61 is provided with the plurality of bolt holes 14 at predetermined intervals on the same circle concentrically with the flange 61 itself.

Each bolt hole 14 is in an elongated hole shape in the rotation direction of the rotor section 24 and in a substantially wedge shape such that the width of the hole at the end in the rotation direction of the rotor section 24 is wider and is conversely narrowed toward the other end in the opposite direction.

The end of each bolt hole 14 in the rotation direction of the rotor section 24 is in an arcuate shape analogous to the bolt 65 such that the bolt 65 can be inserted thereinto with a predetermined clearance, and the bolt 65 is inserted into this end.

Since the width of the bolt hole 14 becomes narrower toward the other end of this hole, the outer diameter of the bolt 65 hits an inner wall of the bolt hole 14 and the bolt 65 is inhibited from sliding into the other end direction even when the bolt 65 is intended to be slid into the other end direction. Thereby, the bolt 65 is positioned at the end of the bolt hole 14.

Each cavity portion 72 penetrating the flange 61 along the elongated direction is provided at the outer periphery side of the bolt hole 14, and thereby the thin-wall portion 71 is formed between the bolt hole 14 and cavity portion 72.

The thickness of the thin-wall portion 71 is on the order of 0.5 millimeters to several millimeters, depending on the material, thickness and the like of the flange 61.

Next, the buffering function of the flange 61 as constituted above will be explained below.

When the rotor section 24 collides with the stator section by rupture of the rotor section 24 or the like in the molecular pump 1 during a high speed rotation of the rotor section, a shock due to torque is caused that intends to rotate the whole of the molecular pump 1 in the rotation direction of the rotor section 24.

Then, the flange 61 tends to slide and rotate in the rotation direction of the rotor section 24 with respect to the flange 62 of the vacuum vessel 205.

Contrary, the position of each bolt 65 is fixed with respect to the flange 62 (the bolt hole of the flange 62 is assumed to be a normal circular one), each bolt 65 relatively moves in the other end direction within the bolt hole 14 as the flange 61 rotates into the rotation direction of the rotor section 24.

Since the width of the bolt hole 14 becomes narrower toward the other end direction, the side wall of the inner periphery of the bolt hole 14 hits the bolt 65 so that the thin-wall portion 71 is pushed in the direction of arrow B (i.e., a direction oriented to the outer radial direction from a tangential direction opposite to the rotation direction of the rotor section 24) and plastically deformed.

The energy for rotating the molecular pump 1 is consumed as energy for plastically deforming the thin-wall portion 71 during the plastic deformation of the thin-wall portion 71, so that the shock is mitigated.

In the embodiment of the present invention as described above, the flange 61 is provided with the buffering mechanism constituted to be plastically deformed by a torque for rotating the molecular pump 1, so that the safety is enhanced, even if the rotor section 24 were ruptured, and even when trouble has occurred such that deposits accumulated at the rotor section 24, stator section and the like upon evacuating the reaction gas from the semiconductor manufacturing system collides with each other within the molecular pump 1.

It is also possible to fill a rubber or other elastic member in the bolt hole 14 and cavity portion 72, as a buffering member.

Further, it is constitutionally possible to form the bolt hole 14 of the flange 61 into a normal screw hole of a circular cross section while providing the bolt hole of the flange 62 at the vacuum vessel 205 side with a thin-wall portion, or to provide thin-wall portions at the bolt holes of both of the flanges 61, 62, respectively.

When a thin-wall portion is provided at the flange 62 at the vacuum vessel 205 side, the thin-wall portion is provided at a position confronting with each bolt hole of the flange 62 in the rotation direction of the rotor.

Figure 4:
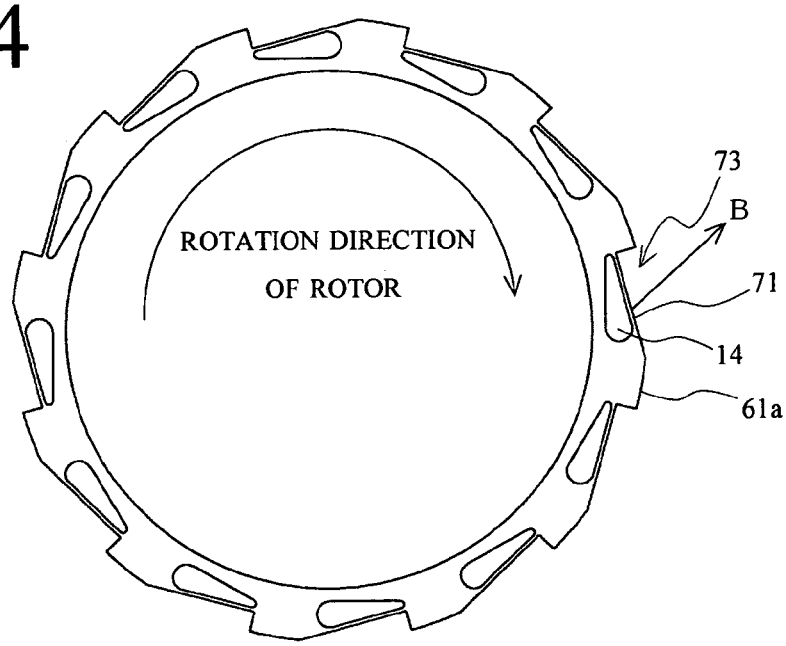
FIG. 4 is a view for explaining a flange in accordance with another embodiment.

FIG. 4 is a view for explaining a flange 61*a* in accordance with another embodiment of the flange 61.

The flange 61*a* has a cutout section 73, instead of the cavity portion 72 of the flange 61.

When a large torque in the rotation direction of the rotor section 24 in the molecular pump 1 is caused and the molecular pump rotates due to breakage of the rotor section 24, for example, the bolt 65 hits the thin-wall portion 71 so that the thin-wall portion 71 is plastically deformed in the direction of arrow B. Thereby, energy for rotating the molecular pump 1 is absorbed, so that the shock caused in the molecular pump 1 is mitigated.

The machining of the cutout section 73 is easier than the cavity portion 72, so that the manufacturing cost can be reduced.

Figure 5:
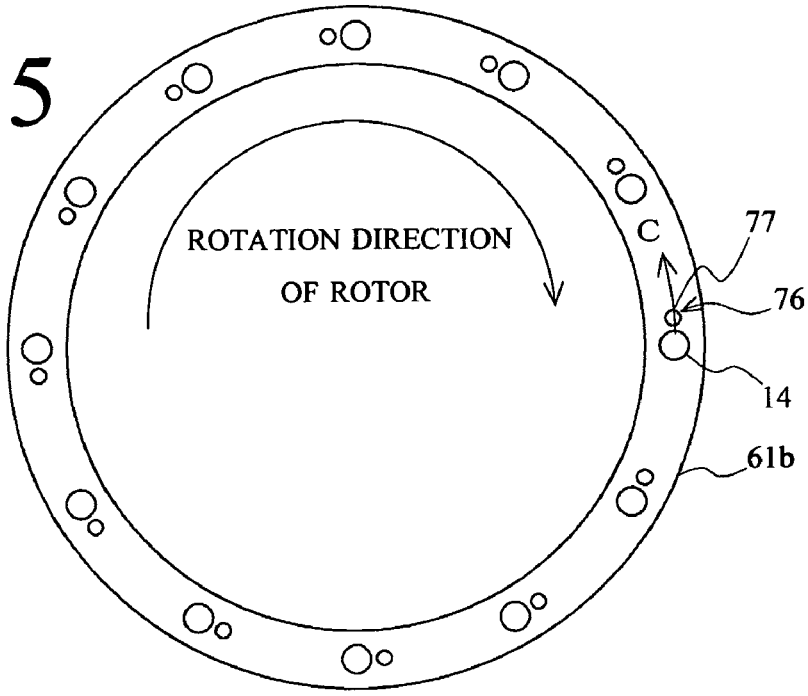
FIG. 5 is a view for explaining a flange in accordance with a further embodiment.

FIG. 5 is a view for explaining a flange 61*b* in accordance with a further embodiment of the flange 61.

In the flange 61*b*, each bolt hole 14 is a normal one having a circular cross section, and adapted to position the bolt 65. Further, a cavity portion 77 is formed at a predetermined distance from the bolt hole 14 in the direction opposite to the rotation direction of the rotor section 24. The cavity portion 77 is a through hole having a circular cross section of an inner diameter smaller than that of the bolt hole 14. The portion 76 between the bolt hole 14 and cavity portion 77 constitutes a thin-wall portion 76.

When a large torque in the rotation direction of the rotor section 24 is caused in the molecular pump 1 using the flange 61*b* constituted as described above so that the molecular pump 1 is rotated, the thin-wall portion 76 and cavity portion 77 are pressurized and plastically deformed in a direction of arrow C (a direction opposite to the rotation direction of the rotor section 24) by the bolt 65 inserted through the bolt hole 14. Thereby, the shock is absorbed.

Figure 6:
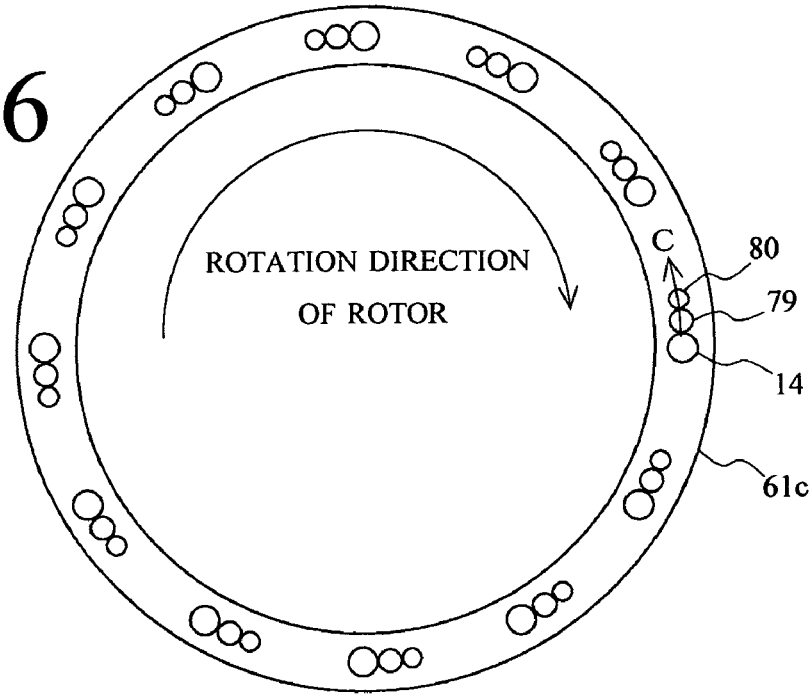
FIG. 6 is a view for explaining a flange in accordance with still another embodiment.

FIG. 6 is a view for explaining a flange 61*c* in accordance with still another embodiment of the flange 61.

In the flange 61*c*, the bolt hole 14 is a normal bolt hole having a circular cross section. Further, a cavity portion 79 is formed at a predetermined distance from the bolt hole 14 in the direction opposite to the rotation direction of the rotor section 24. The cavity portion 79 is a through hole having a circular cross section of an inner diameter smaller than that of the bolt hole 14. Moreover, a cavity portion 80 is formed at a predetermined distance from the cavity portion 79 in the direction opposite to the rotation direction of the rotor section 24. The cavity portion 80 is a through hole having a circular cross section of an inner diameter smaller than that of the cavity portion 79.

The portions between the bolt hole 14 and cavity portion 79 and between the cavity portion 79 and cavity portion 80 constitute thin-wall portions, respectively.

When a large torque in the rotation direction of the rotor section 24 is caused in the molecular pump 1 using the flange 61*c* constituted as described above so that the molecular pump 1 is rotated, these thin-wall portions and the cavity portions 79, 80 are pressurized and plastically deformed in a direction of arrow C (a direction opposite to the rotation direction of the rotor section 24) by the bolt 65 inserted through the bolt hole 14. Thereby, the shock is absorbed.

Figure 7:
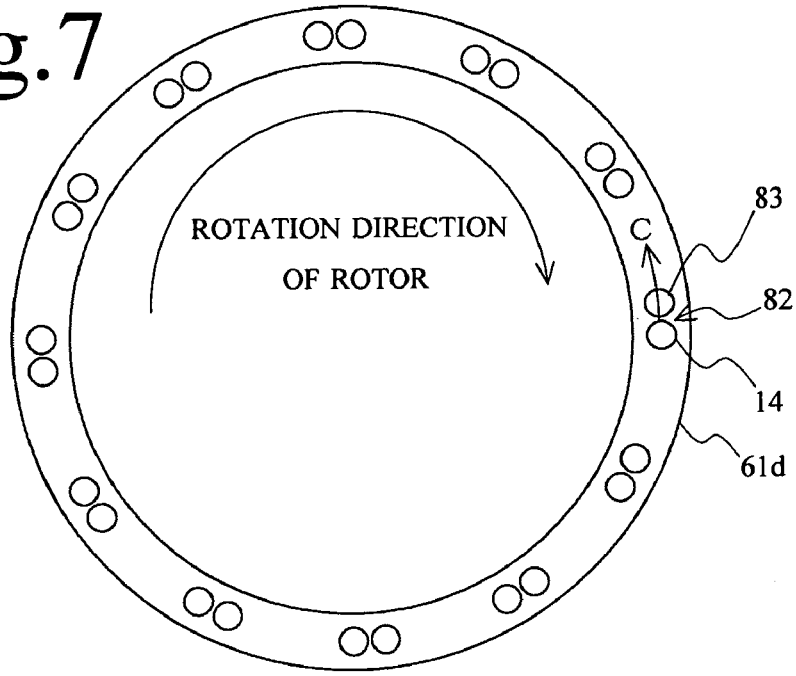
FIG. 7 is a view for explaining a flange in accordance with a still further embodiment.

FIG. 7 is a view for explaining a flange 61*d* in accordance with a still further embodiment of the flange 61.

In the flange 61*d*, each bolt hole 14 is a normal one having a circular cross section. Further, a cavity portion 83 is formed at a predetermined distance from the bolt hole 14 in the direction opposite to the rotation direction of the rotor section 24. The cavity portion 83 is a through hole having a circular cross section of the same inner diameter as that of the bolt hole 14. The portion between the bolt hole 14 and cavity portion 83 constitutes a thin-wall portion 82.

When a large torque in the rotation direction of the rotor section 24 is caused in the molecular pump 1 using the flange 61*d* constituted as described above so that the molecular pump 1 is rotated, the thin-wall portion 82 and cavity portion 83 are pressurized and plastically deformed in a direction of arrow C (a direction opposite to the rotation direction of the rotor section 24) by the bolt 65 inserted through the bolt hole 14. Thereby, the shock is absorbed.

The inner diameter of the cavity portion 83 can be constituted to be larger than that of the bolt hole 14.

Figure 8:
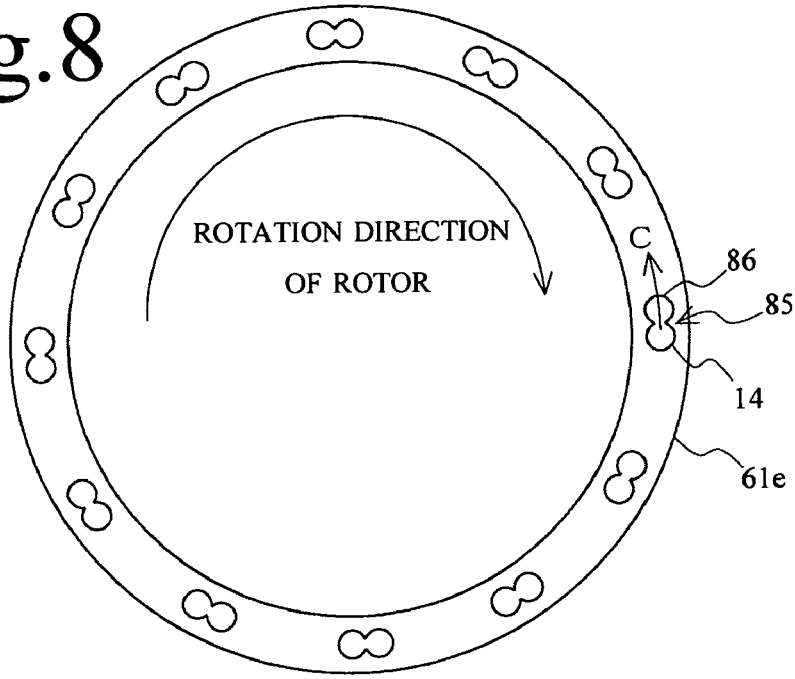
FIG. 8 is a view for explaining a flange in accordance with yet another embodiment.

FIG. 8 is a view for explaining a flange 61*e* in accordance with yet another embodiment of the flange 61.

In the flange 61*e*, each bolt hole 14 is a normal one having a circular cross section. Further, a cavity portion 86 is formed at a predetermined distance from the bolt hole 14 in the direction opposite to the rotation direction of the rotor section 24. The cavity portion 86 is a through hole having a circular cross section of the same inner diameter as that of the bolt hole 14. In this embodiment, the distance between centers of the bolt hole 14 and cavity portion 86 is set to be shorter than the sum of the radii of the bolt hole 14 and cavity portion 86, and the bolt hole 14 and cavity portion 86 are interconnected with each other.

Further, the constricted region between the bolt hole 14 and cavity portion 86 forms a thin-wall portion 85.

When a large torque in the rotation direction of the rotor section 24 is caused in the molecular pump 1 using the flange 61*e* constituted as described above so that the molecular pump 1 is rotated, the thin-wall portion 85 is pressurized and plastically deformed in a direction of arrow C (a direction opposite to the rotation direction of the rotor section 24) by the bolt 65 inserted through the bolt hole 14. Thereby, the shock is absorbed.

Figure 9:
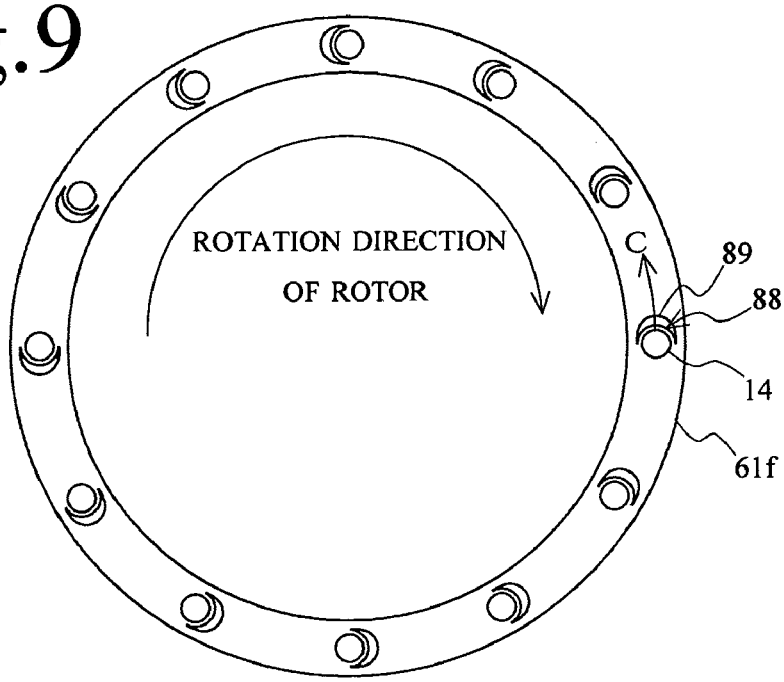
FIG. 9 is a view for explaining a flange in accordance with a yet further embodiment.

FIG. 9 is a view for explaining a flange 61*f* in accordance with a yet further embodiment of the flange 61.

In the flange 61*f*, each bolt hole 14 is a normal one having a circular cross section. Further, a cavity portion 89 constituted by a through hole having a crescent cross section is formed at a predetermined distance from the bolt hole 14 in the direction opposite to the rotation direction of the rotor section 24. The crescent cross section is arranged so that its concave portion is confronted with the bolt hole 14 via thin-wall portion 88. Further, the R-shape of the concave portion is set so that the thickness of the thin-wall portion 88 becomes substantially uniform.

When a large torque in the rotation direction of the rotor section 24 is caused in the molecular pump 1 using the flange 61*f* constituted as described above so that the molecular pump 1 is rotated, the thin-wall portion 88 is pressurized and plastically deformed in a direction of arrow C (a direction opposite to the rotation direction of the rotor section 24) by the bolt 65 inserted through the bolt hole 14. Thereby, the shock is absorbed.

Figure 10:
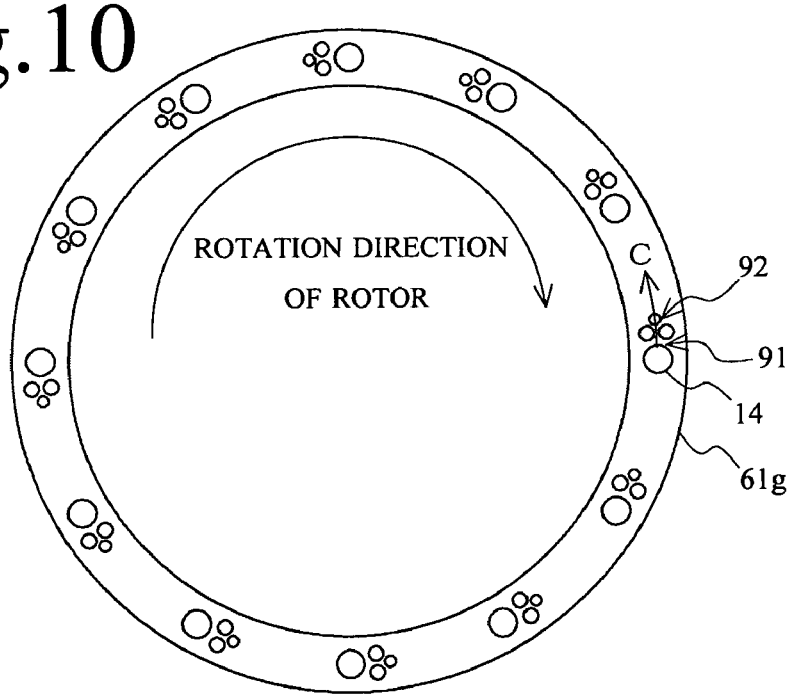
FIG. 10 is a view for explaining a flange in accordance with another embodiment.

FIG. 10 is a view for explaining a flange 61*g* in accordance with another embodiment of the flange 61.

In the flange 61*g*, each bolt hole 14 is a normal one having a circular cross section. Further, a cavity portion 92 is formed at a predetermined distance from the bolt hole 14 in the direction opposite to the rotation direction of the rotor section 24.

The cavity portion 92 is constituted by three through holes each having a circular cross section. Two of these through holes have the same inner diameters, and are formed to be separated from the bolt hole 14 via thin-wall portion 91 and aligned in the radial direction. Thereby, a point intermediate between these two through holes is set to be positioned on a circle passing through the center of the bolt hole 14 and concentric with the flange 61*g*. Further, the remaining one through hole is formed at an opposite side to the rotation direction of the rotor section 24 and beyond the former two through holes, and the center of this remaining through hole is positioned on the circle passing through the center of the bolt hole 14 and concentric with the flange 61*g*.

In such a cavity portion 92, the thin-wall portion 91 is formed between the cavity portion 92 and bolt hole 14, and thin-wall portions are further formed between the three through holes constituting the cavity portion 92.

When a large torque in the rotation direction of the rotor section 24 is caused in the molecular pump 1 using the flange 61*g* constituted as described above so that the molecular pump 1 is rotated, the thin-wall portion 91 as well as the thin-wall portions between the three through holes constituting the cavity portion 92 are pressurized and plastically deformed in a direction of arrow C (a direction opposite to the rotation direction of the rotor section 24) by the bolt 65 inserted through the bolt hole 14. Thereby, the shock is absorbed.

Figure 11:
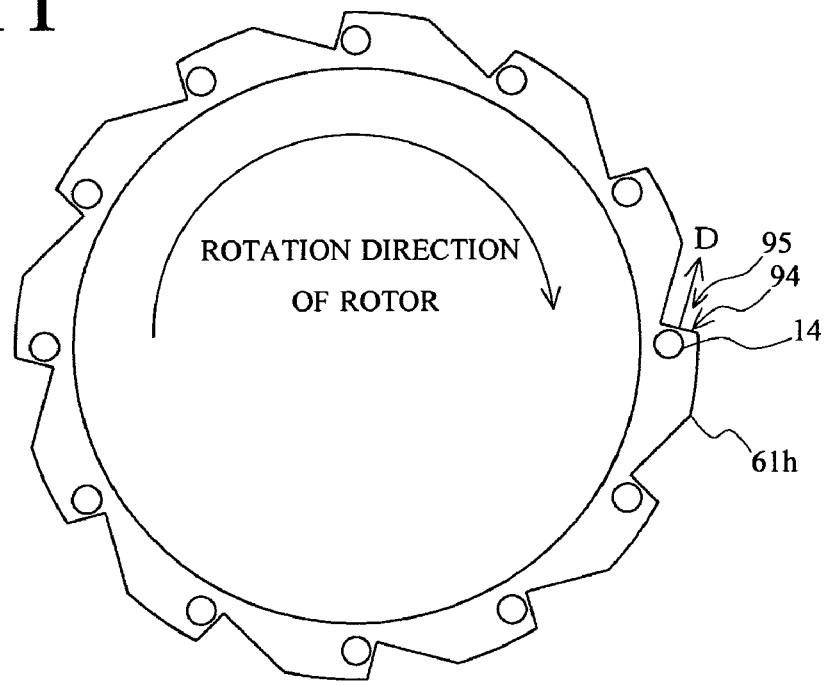
FIG. 11 is a view for explaining a flange in accordance with a further embodiment.

FIG. 11 is a view for explaining a flange 61*h* in accordance with a further embodiment of the flange 61.

In the flange 61*h*, each bolt hole 14 is a normal one having a circular cross section. Further, a cutout section 95 is formed apart from the bolt hole 14 in the direction opposite to the rotation direction of the rotor section 24 and via thin-wall portion 94.

The cutout section 95 is formed in a direction (direction of arrow D in FIG. 11) oriented from the thin-wall portion 94 to an outer radial direction from a tangential direction of a circumference of the flange 61*h*.

When a large torque in the rotation direction of the rotor section 24 is caused in the molecular pump 1 using the flange 61*h* constituted as described above so that the molecular pump 1 is rotated, the thin-wall portion 94 is pressurized and plastically deformed in the direction of arrow D by the bolt 65 inserted through the bolt hole 14. Thereby, the shock is absorbed.

Figure 12:
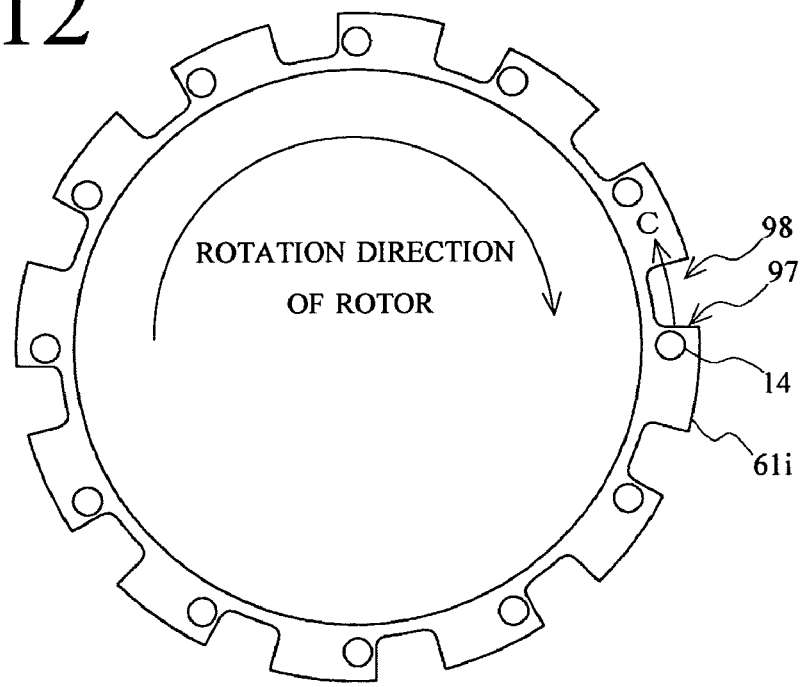
FIG. 12 is a view for explaining a flange in accordance with still another embodiment.

FIG. 12 is a view for explaining a flange 61*i* in accordance with still another embodiment of the flange 61.

In the flange 61*i*, each bolt hole 14 is a normal one having a circular cross section. Further, a cutout section 98 is formed apart from the bolt hole 14 in the direction opposite to the rotation direction of the rotor section 24 and via thin-wall portion 97.

The cutout section 98 is formed to hollow out an outer periphery of the flange 61*i* in the radial direction, via thin-wall portion 97.

When a large torque in the rotation direction of the rotor section 24 is caused in the molecular pump 1 using the flange 61*i* constituted as described above so that the molecular pump 1 is rotated, the thin-wall portion 97 is pressurized and plastically deformed in a direction of arrow C by the bolt 65 inserted through the bolt hole 14. Thereby, the shock is absorbed.

Figure 13:
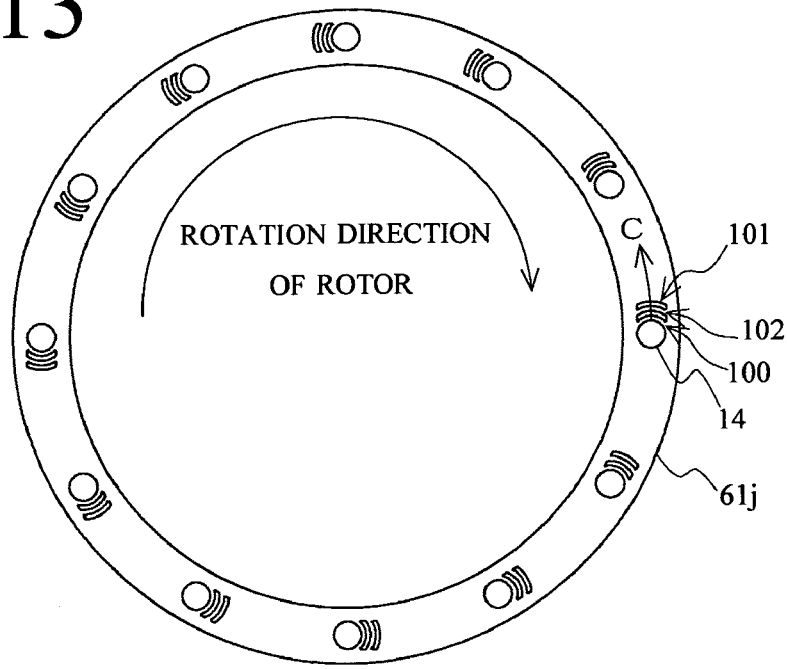
FIG. 13 is a view for explaining a flange in accordance with a still further embodiment.

FIG. 13 is a view for explaining a flange 61*j* in accordance with a still further embodiment of the flange 61.

In the flange 61*j*, the bolt hole 14 is a normal bolt hole having a circular cross section. Further, a cavity portion 101 is formed apart from the bolt hole 14 in the direction opposite to the rotation direction of the rotor section 24 and via thin-wall portion 100.

The cavity portion 101 is formed of two arcuate through holes. These two through holes are circumferentially juxtaposed with each other and arranged at predetermined distances from the bolt hole 14, respectively, such that the concave portions of these through holes confront with the bolt hole 14. Thereby, a thin-wall portion 102 is also formed between the two through holes.

When a large torque in the rotation direction of the rotor section 24 is caused in the molecular pump 1 using the flange 61*j* constituted as described above so that the molecular pump 1 is rotated, the thin-wall portion 100 and thin-wall portion 102 are pressurized and plastically deformed in a direction of arrow C (a direction opposite to the rotation direction of the rotor section 24) by the bolt 65 inserted through the bolt hole 14. Thereby, the shock is absorbed.

Figure 14:
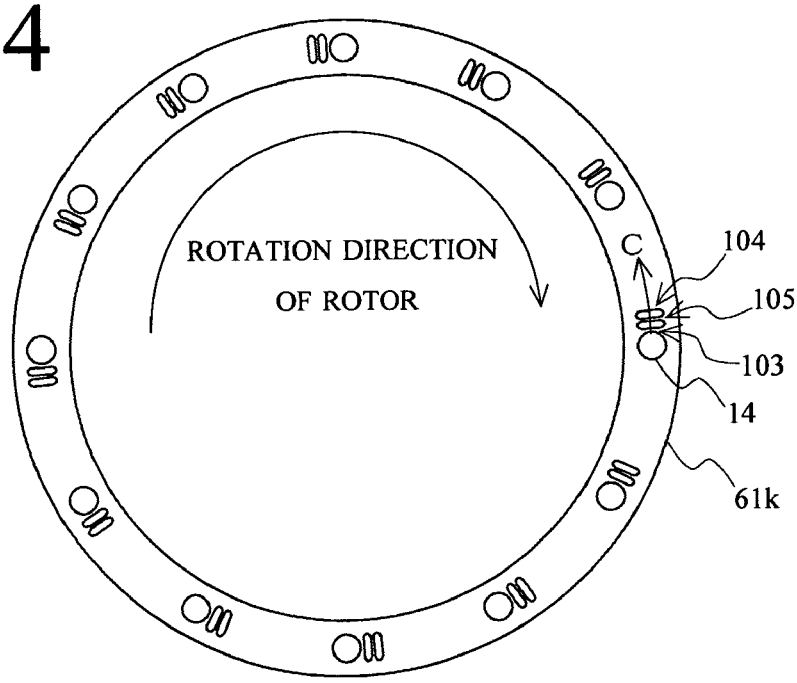
FIG. 14 is a view for explaining a flange in accordance with yet another embodiment.

FIG. 14 is a view for explaining a flange 61*k* in accordance with yet another embodiment of the flange 61.

In the flange 61*k*, the bolt hole 14 is a normal bolt hole having a circular cross section. Further, a cavity portion 104 is formed apart from the bolt hole 14 in the direction opposite to the rotation direction of the rotor section 24 and via thin-wall portion 103.

The cavity portion 104 is formed of two through holes in elongated hole shapes. These two through holes are circumferentially juxtaposed with each other and arranged at predetermined distances from the bolt hole 14, respectively, such that those sides having the larger curvatures of the elongated holes confront with the bolt hole 14. Thereby, a thin-wall portion 105 is also formed between the two through holes.

When a large torque in the rotation direction of the rotor section 24 is caused in the molecular pump 1 using the flange 61*k* constituted as described above so that the molecular pump 1 is rotated, the thin-wall portion 103 and the thin-wall portion 105 formed between the two through holes are pressurized and plastically deformed in a direction of arrow C (a direction opposite to the rotation direction of the rotor section 24) by the bolt 65 inserted through the bolt hole 14. Thereby, the shock is absorbed.

Figure 15:
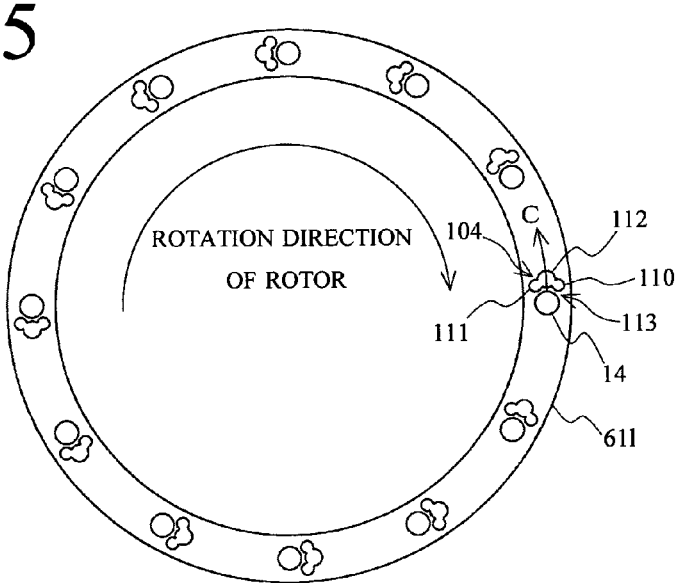
FIG. 15 is a view for explaining a flange in accordance with a yet further embodiment.

FIG. 15 is a view for explaining a flange 61*l* in accordance with a yet further embodiment of the flange 61.

In the flange 61*l*, the bolt hole 14 is a normal bolt hole having a circular cross section. Further, a cavity portion 109 is formed apart from the bolt hole 14 in the direction opposite to the rotation direction of the rotor section 24 and via thin-wall portion 113.

The cavity portion 109 is constituted by through holes 110, 111, 112 having circular cross sections, respectively. The through hole 111 and through hole 110 are formed at inner and outer peripheral sides, respectively, and the through hole 112 is formed between the through holes 110, 111.

The distance between centers of the through hole 110 and through hole 112 is set to be smaller than the sum of the radii of the through holes 110, 112 so that the through holes 110, 112 are continuous with each other.

Similarly, the distance between centers of the through hole 111 and through hole 112 is set to be smaller than the sum of the radii of the through holes 111, 112 so that the through holes 111, 112 are continuous with each other. Although the inner diameter of the through hole 112 is set to be larger than those of the through holes 111, 110 concerning the cavity portion 109, all of these through holes may have the same inner diameters, and the inner diameter of the through hole 112 may be smaller than those of the through holes 110, 111.

Further, the center of the through hole 112 is positioned apart from the centers of the through holes 110, 111 in a direction of arrow C (a direction opposite to the rotation direction of the rotor section 24). Thus, a thin-wall portion 113 formed between the cavity portion 109 and bolt hole 14 is made convex in the direction of arrow C.

When a large torque in the rotation direction of the rotor section 24 is caused in the molecular pump 1 using the flange 61*l* constituted as described above so that the molecular pump 1 is rotated, the thin-wall portion 113 is pressurized and plastically deformed in the direction of arrow C (the direction opposite to the rotation direction of the rotor section 24) by the bolt 65 inserted through the bolt hole 14. Thereby, the shock is absorbed.

The cavity portion 109 can be formed by simply forming through holes at three positions by a milling machine, for example, so that machining thereof is easy.

Figure 16:
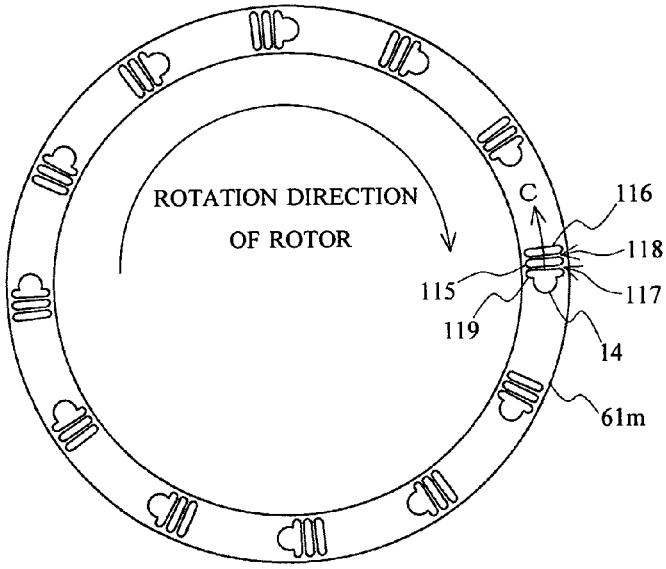
FIG. 16 is a view for explaining a flange in accordance with another embodiment.
Figure 16:
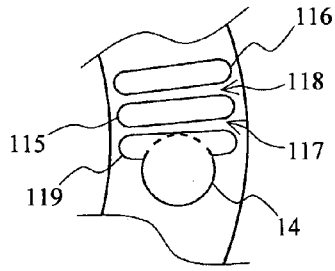

FIG. 16(*a*) is a view for explaining a flange 61*m* in accordance with another embodiment of the flange 61. FIG. 16(*b*) is an enlarged view near the bolt hole 14.

In the flange 61*m*, the bolt hole 14 is a normal bolt hole having a circular cross section.

Further, an elongated hole 119 which is a through hole in an elongated hole shape in the radial direction is formed in a direction of arrow C of the bolt hole 14 (a direction opposite to the rotation direction of the rotor section 24) and at a position having a distance from the center of the bolt hole 14 which distance is shorter than the inner diameter of the bolt hole 14. Thereby, the bolt hole 14 is continuous with the elongated hole 119 in the direction of arrow C. The inner diameter of the elongated hole 119 in the elongated direction is set to be larger than the inner diameter of the bolt hole 14.

Further, the position of the elongated hole 119 in the direction C is set so that an arc drawn by extending the inner diameter of the bolt hole 14 within the elongated hole 119 is tangent to an inner peripheral surface of the elongated hole 119. Then, elongated holes 115, 116 in the shapes analogous to the elongated hole 119 are formed in the direction C of the elongated hole 119, and a thin-wall portion 117 is formed between the elongated hole 119 and elongated hole 115. Further, a thin-wall portion 118 is formed between the elongated hole 115 and elongated hole 116.

When a large torque in the rotation direction of the rotor section 24 is caused in the molecular pump 1 using the flange 61*m* constituted as described above so that the molecular pump 1 is rotated, the thin-wall portion 117 is pressurized and plastically deformed in the direction of arrow C (the direction opposite to the rotation direction of the rotor section 24) by the bolt 65 inserted through the bolt hole 14. Then, the plastically deformed thin-wall portion 117 further presses and plastically deforms the thin-wall portion 118. Thereby, the thin-wall portions 117, 118 are plastically deformed so that the shock is absorbed.

Although the buffering mechanism has been constituted by providing a plastically deformable thin-wall portion(s) near the bolt hole 14 of the flange 61 as described above, the shapes of the thin-wall portions are not limited to the embodiments described above and various configurations are additionally conceivable.

Further, although the molecular pump 1 is of the hybrid vane type constituted by the turbo-molecular pump section and the screw groove pump section, the type of the molecular pump 1 is not limited thereto, and may be of a full vane type of turbo-molecular pump in which the pump is wholly constituted by stator vanes and rotor vanes from the gas inlet port 6 side up to the gas discharge port 19 side.

According to the embodiments of the present invention as explained above, the following effects can be obtained.

(1) The shock in the rotation direction of the rotor section 24 can be effectively absorbed, by such a simple structure that cavity portions or cutout sections are provided near the bolt hole 14 so as to form the thin-wall portion(s).

(2) The structure is simple, so that the manufacturing is inexpensive.

(3) Since the buffering mechanism is constituted at the flange 61, use can be made irrespectively of the internal structure of the molecular pump 1.

(4) Since the flange 61 is provided with the buffering mechanism, the joining portions between the molecular pump 1 and vacuum vessel 205 can withstand the practical use even when the strength of these joining portions are weaker than the conventional one. Thus, it is possible to reduce the number of bolts 65 or to use a bolt 65 of strength lower than the conventional one, for example, and additionally, it becomes unnecessary to provide a shell-like safety cover (safety cover for covering the whole of the molecular pump 1) so that a total cost can be reduced.

(5) The position of the bolt 65 within the bolt hole 14 can be readily determined, so that the workability is improved.

Next, an example of a buffering mechanism, which can be readily analyzed by a computer, will be explained.

By a recent remarkable advancement in an analysis technique utilizing a computer, it has become possible to previously calculate a buffering effect by a buffering mechanism.

Since a molecular pump is an expensive product, it becomes possible to restrict the number of experiments using real molecular pumps by conducting such experiments after previously conducting simulations by a computer so as to select out candidates of shapes for buffering mechanism.

Particularly, since a molecular pump is an expensive product, the developing cost can be reduced by conducting such simulations.

In the simulation, a model as a calculation target is created by setting the data such as shape, dimensions and material as parameters of the buffering mechanism, and thereafter a magnitude of shock to be caused within the molecular pump is inputted and the way in which the buffering mechanism absorbs this shock is numerically calculated. To the numerical calculation, a known theory such as a finite element method is applied.

After selecting out those candidates of buffering mechanism which exhibit desired effects while changing the parameters, fracture experiments of molecular pumps are actually performed and compared with the simulation results.

Based on the comparison results, the buffering mechanism to be actually practiced is determined.

In case of designing a buffering mechanism by performing simulations in the above manner, it is important to select a shape which can be easily calculated and easily machined.

As shapes satisfying such requirements, there are thin-wall portions formed into flat plate shapes.

When the thin-wall portions are in the flat plate shapes, the thickness of portions to be plastically deformed becomes uniform so that the calculation is very easy. Further, machining is also easy, and the experimental results fit well.

Examples of cases where thin-wall portions are formed into flat plate shapes will be described below, with reference to FIG. 17, FIG. 18.

Figure 17:
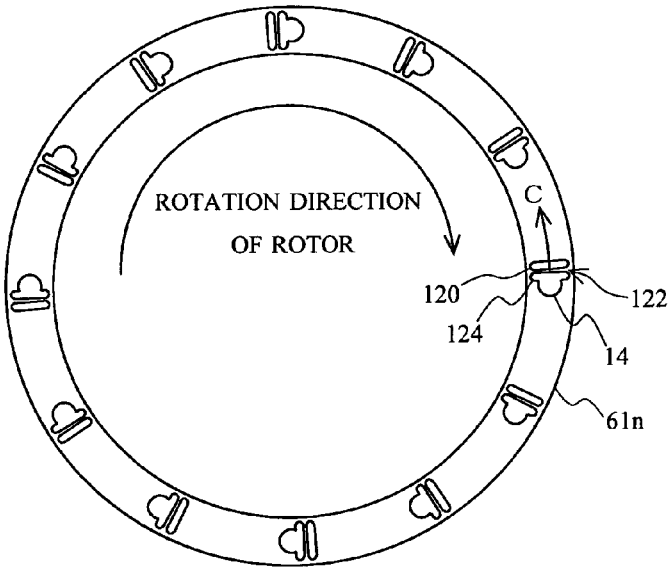
FIG. 17 is a view for explaining a flange in accordance with a further embodiment.
Figure 17:
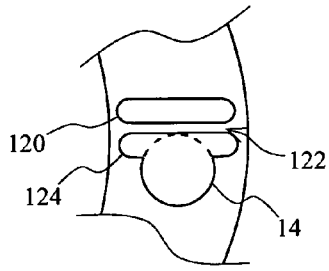

FIG. 17(*a*) is a view for explaining a flange 61*n* in accordance with a further embodiment of the flange 61, and FIG. 17(*b*) is an enlarged view near the bolt hole 14.

In the flange 61*n*, the bolt hole 14 is a normal bolt hole having a circular cross section.

Further, an elongated hole 124 which is a through hole in an elongated hole shape in the radial direction is formed in a direction of arrow C of the bolt hole 14 (a direction opposite to the rotation direction of the rotor section 24) and at a position having a distance from the center of the bolt hole 14 which distance is shorter than the inner diameter of the bolt hole 14. Thereby, the elongated hole 124 is continuous with the bolt hole 14 in the direction of arrow C. The inner diameter of the elongated hole 124 in the elongated direction is set to be larger than the inner diameter of the bolt hole 14.

Further, the position of the elongated hole 124 in the direction C is set so that an arc drawn by extending the inner diameter of the bolt hole 14 within the elongated hole 124 is tangent to an inner peripheral surface of the elongated hole 124. Then, an elongated hole 120 in the shape analogous to the elongated hole 124 is formed in the direction C of the elongated hole 124, and a thin-wall portion 122 is formed between the elongated hole 124 and elongated hole 120.

Since the elongated hole 124 and elongated hole 120 are parallel to each other, the thin-wall portion 122 is in a flat plate shape having a constant thickness.

When a large torque in the rotation direction of the rotor section 24 is caused in the molecular pump 1 using the flange 61*n* constituted as described above so that the molecular pump 1 is rotated, the thin-wall portion 122 is pressurized and plastically deformed in the direction of arrow C (the direction opposite to the rotation direction of the rotor section 24) by the bolt 65 inserted through the bolt hole 14, so that the shock is absorbed.

Figure 18:
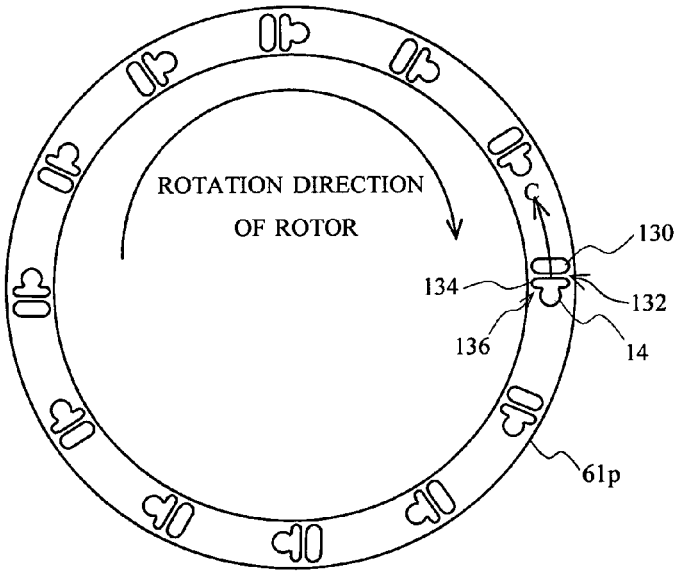
FIG. 18 is a view for explaining a flange in accordance with still another embodiment.
Figure 18:
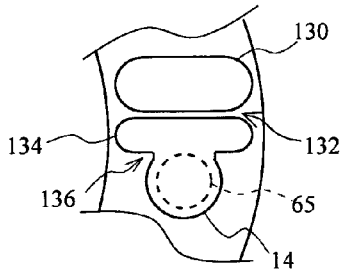

FIG. 18(*a*) is a view for explaining a flange 61*p* in accordance with still another embodiment of the flange 61, and FIG. 18(*b*) is an enlarged view near the bolt hole 14.

The flange 61*p* has its buffering portion constituted by the bolt hole 14 having a circular cross section, a guiding portion 136 for guiding the bolt 65 toward a thin-wall portion 132, and elongated holes 134, 130 (first and second through-holes) acting as through holes for forming the thin-wall portion 132.

The bolt hole 14 is a through hole through which the bolt 65 is inserted. The inner diameter of the bolt hole 14 is set to be larger than the outer diameter of the bolt 65 by a predetermined value, and a predetermined clearance is set between an inner wall surface of the bolt hole 14 and an outer surface portion of the bolt 65.

The elongated hole 134 is connected to the bolt hole 14 in the direction of arrow C (a direction opposite to the rotation direction of the rotor section 24) via guiding portion 136.

The guiding portion 136 is a gap formed in the radial direction, and this gap has a width which is set to be substantially equal to or larger than the outer diameter of the bolt 65 and smaller than the inner diameter of the bolt hole 14.

When a larger torque is caused in the rotation direction of the rotor section 24 and the flange 61*p* is rotated, the bolt 65 is to be guided through the guiding portion 136 toward the center of the thin-wall portion 132.

The simulation is performed on the assumption that the bolt 65 hits the center of the thin-wall portion 132, and the bolt 65 can be guided to the position assumed by the simulation by forming the guiding portion 136.

The elongated hole 130 is formed parallelly to the elongated hole 134, in the direction of arrow C of the elongated hole 134. The length of the elongated hole 134 in the longitudinal direction is set to be the same as the elongated hole 130, and the thin-wall portion 132 is formed between the elongated hole 134 and elongated hole 130.

The thin-wall portion 132 is formed of inner wall surfaces of the elongated hole 134 and elongated hole 130, and constitutes a flat plate shape having a constant thickness.

The thickness of the thin-wall portion 132 is set by performing a simulation and experiments.

The length of the thin-wall portion 132 in the radial direction of the flange 61*p* is such that the side surface of the bolt 65 touches the thin-wall portion 132 at least upon plastic deformation of the guiding portion 136.

Further, if the plastic deformation to be caused in the thin-wall portion 132 spreads to regions beyond the portion to be touched the bolt 65, such regions to which the plastic deformation spreads may be formed into flat plate shapes.

When a large torque in the rotation direction of the rotor section 24 is caused in the molecular pump 1 using the flange 61*p* constituted as described above so that the molecular pump 1 is rotated, the bolt 65 inserted through the bolt hole 14 moves in the direction C relative to the flange 61*p*.

At this time, the bolt 65 is guided by the guiding portion 136 and collides with the central portion of the thin-wall portion 132. The thin-wall portion 132 is plastically deformed by this collision, and buffers the shock.

Thereby, the bolt 65 can be collided with the intended position (central portion) of the thin-wall portion 132 by providing the guiding portion 136 for guiding the bolt 65, so that the thin-wall portion 132 can be plastically deformed in the same manner as calculated by the simulation.

Figure 19:
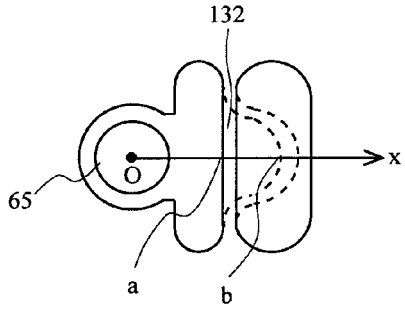
FIG. 19 is a view for explaining a relationship between a plastic deformation strength of a thin-wall portion and a rupture strength of a bolt.
Figure 19:
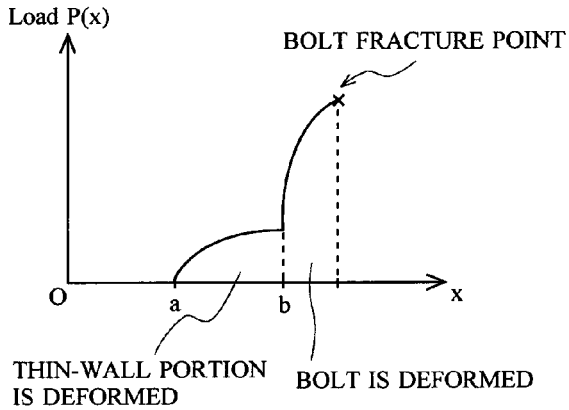

FIG. 19 is a view for explaining a relationship between a plastic deformation strength of the thin-wall portion 132 and a rupture strength of the bolt 65.

FIG. 19(*a*) shows the bolt hole 14 in FIG. 18(*a*). Here, the center of the bolt 65 is assumed to be an origin O, and an x-axis is set from the origin O in a direction opposite to the rotation direction of the rotor section 24. The thin-wall portion 132 after deformation is shown by a dotted line.

When the molecular pump 1 is rotated, the bolt 65 touches the thin-wall portion 132 at x=a and thereafter reaches x=b while deforming the thin-wall portion 132.

FIG. 19(*b*) is a graph having an abscissa representing a moved amount of the bolt 65 and an ordinate representing a load P(x) acting on the bolt 65 as the bolt 65 moves.

As shown in FIG. 19(*b*), the load P(x) starts to act on the bolt 65 at x=a, and the load gradually increases up to x=b. During this interval, mainly the thin-wall portion 132 is deformed.

When the bolt 65 reaches x=b, the thin-wall portion 132 hits the side surface of the elongated hole 130 and does not deform any more and thereafter the bolt 65 is deformed. During the interval where the bolt 65 moves in a +x direction while being deformed, the load P(x) increases steeply, and the bolt 65 ruptures upon reaching a fracture point.

In this embodiment of the present invention, since the plastic deformation strength of the thin-wall portion 132 is set to be lower than the rupture strength of the bolt 65, the load P(x) required for the rupture of the bolt 65 is larger than the load P (x) required for deformation of the thin-wall portion 132 as described above. Thereby, the thin-wall portion 132 can be deformed to the maximum extent before the bolt 65 ruptures. Thus, it becomes possible to prevent the bolt 65 from rupturing before the thin-wall portion 132 is fully deformed, so that the thin-wall portion 132 can sufficiently exhibit the buffering effect.

Figure 20:
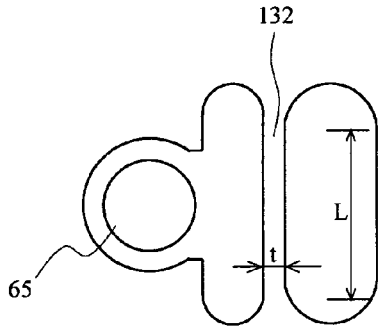
FIG. 20 is a view for explaining parameters for determining a plastic deformation strength of a thin-wall portion.

FIG. 20 is a view for explaining parameters which determine the plastic deformation strength of the thin-wall portion 132.

The plastic deformation strength of the thin-wall portion 132 is determined by a thickness t of the thin-wall portion 132, a length L of the thin-wall portion 132, a thickness T of the flange 61, material of the flange 61 and the like.

By inputting these parameter into a simulation software, the plastic deformation strength of the thin-wall portion 132 is automatically calculated.

Since the rupture strength of the bolt 65 is previously known and the material and thickness T of the flange 61 are previously determined, the shape of the thin-wall portion 132 is designed within a range satisfying the conditions while varying the thickness t of the thin-wall portion 132 and the length L of the thin-wall portion 132.

Next, a washer to be mounted on the bolt 65 is explained.

Although a case where the washer is mounted between the flange 61*p* and the bolt 65 is explained below, this can be applied to other types of flanges 61.

Figure 21:
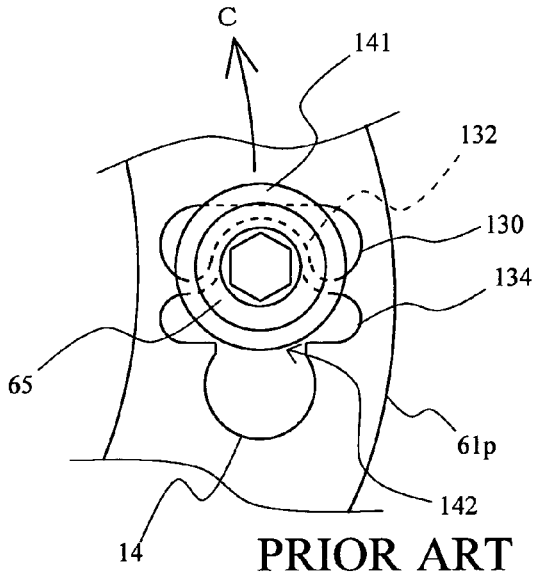
FIG. 21 is a view for explaining a conventional washer.
Figure 21:
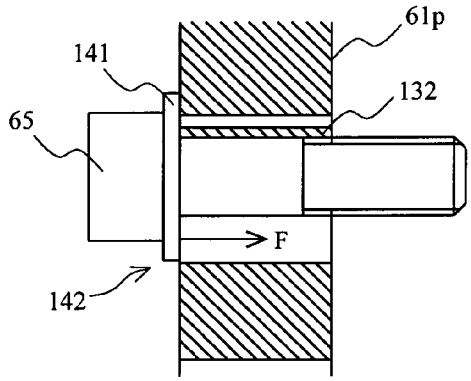
PRIOR ART Fig.21 (b)

FIGS. 21(*a*), 21(*b*) are views for explaining a conventional washer. FIG. 21(*a*) is a plan view, and FIG. 21(*b*) is a cross-sectional view.

A washer 141 is a ring-like disk member having an outer diameter larger than that of a bolt-head of the bolt 65 and an inner diameter larger than an outer diameter of a thread portion of the bolt 65.

The washer 141 is mounted on the flange 61*p* by inserting the bolt 65 therethrough, and is urged by the bolt-head onto a surface of the flange 61*p* in the mounted state.

The washer 141 constituted thereby is moved in the direction of arrow C (a direction opposite to the rotation direction of the rotor section 24) together with the bolt 65 upon deformation of the thin-wall portion 132.

At this time, the bolt 65 receives a force from the thin-wall portion 132, in a direction opposite to the direction of arrow C. Thus, a force F acts on a washer end 142 at a side opposite to the direction of arrow C of the bolt hole 14, which force F drops the washer end into the bolt hole 14.

However, the washer end 142 is positioned above the bolt hole 14, and it is impossible to generate a force for supporting the bolt 65 against the force F.

Thus, the washer end 142 drops into the bolt hole 14 and the bolt 65 is inclined, so that it becomes difficult to plastically deform the thin-wall portion 132 equally.

Figure 22:
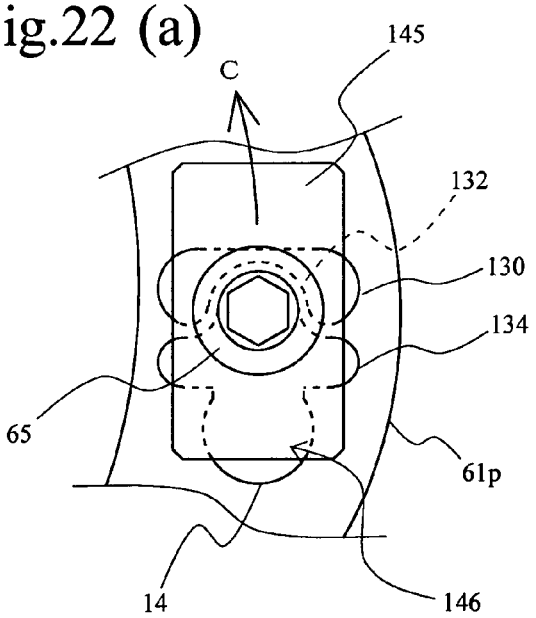
PRIOR ART Fig.22 (a)
FIG. 22 is a view for explaining a washer of an embodiment in accordance with the present invention.
Figure 22:
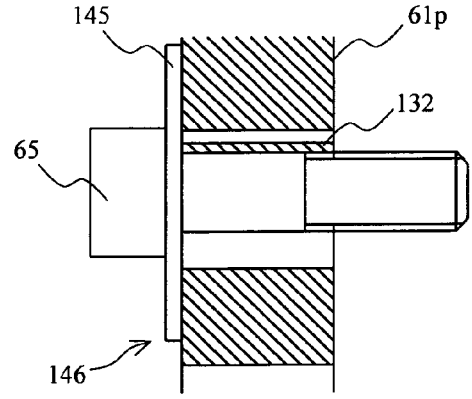
Figure 23:
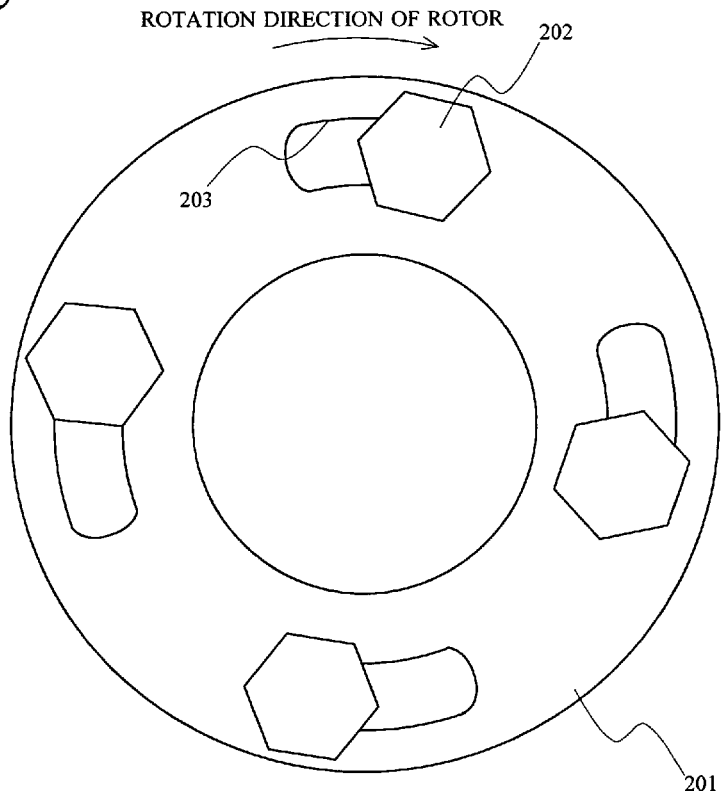
FIG. 23 is a view for explaining a flange having a buffering mechanism proposed in the patent-related reference 1.

FIGS. 22(*a*), (*b*) are views for explaining a washer for improving the above described defect. FIG. 22(*a*) is a plan view and FIG. 22(*b*) is a cross-sectional view.

A washer 145 has a rectangular shape and is elongated in the moving direction of the flange 61*p*.

Thereby, it becomes possible to prevent the bolt-head from dropping into the bolt hole 14 even when the bolt 65 is moved in the direction of arrow C (a direction opposite to the rotation direction of the rotor section 24) and the thin-wall portion 132 is plastically deformed, because the washer 145 touches the surface of the flange 61*p* in any positions from the center of the bolt-head up to a washer end 146.

Thereby, it is possible to prevent the bolt 65 from inclining upon plastic deformation of the thin-wall portion 132, so that the thin-wall portion 132 can be plastically deformed equally.

Thus, the thin-wall portion 132 can be plastically deformed as correctly as simulated.

The shape of the washer 145 is not limited to the rectangular shape, and variously conceivable depending on the shape of the bolt hole 14.

For example, since the washer is to be existent between the bolt-head of the bolt 65 inserted into the bolt hole 14 and the flange 61*p*, it is enough that a portion at least touching the flange 61*p* is existent in a region of the washer 145 between the center of the bolt-head and the washer end 146 in the rotation direction of the rotor section 24, at a position where the bolt 65 has been moved in the direction of the thin-wall portion 132 by a shock due to the torque caused in the casing 16 by collision of the rotor section 24.

Alternatively, it is enough that the distance from the center of the bolt 65 up to the washer end 146 in the rotation direction of the rotor section 24 is at least larger than a length which is the sum of a distance from the center of the bolt 65 up to the end of the bolt hole 14 in the rotation direction of the rotor section 24, and a moved amount of the bolt 65 in the direction of the thin-wall portion 132 by a shock due to a torque caused in the casing 16 by collision of the rotor section 24.

Further, it is alternatively enough that the washer 145 includes a portion having a width wider than that of the bolt hole 14 toward the rotation direction of the rotor section 24 after the bolt 65 is moved.

As described above, the thin-wall portion constituting the buffering mechanism is constituted into the flat plate shape, so that the simulation is facilitated and machining becomes easy.

Thereby, the developing cost and manufacturing cost of the molecular pump provided with the buffering mechanism can be reduced.

Further, the plastic deformation strength of the thin-wall portion is set to be lower than the rupture strength of the bolt, so that the buffering function of the buffering mechanism can be exhibited to the maximum extent.

Moreover, by using the washer having its longitudinal direction coincident with the moving direction of the flange, it becomes possible to restrict the inclination of the bolt upon plastic deformation of the thin-wall portion and to plastically deform the thin-wall portion uniformly. Thereby, the excellent buffering function obtained by the simulation can be realized.

Although the first embodiment of the present invention has been described above, the present invention is not limited to the described embodiments and can be variously modified within a scope recited in the appended claims.

What is claimed is:

1. A molecular pump comprising:

a casing having a gas inlet port and a gas discharge port;

a stator disposed within the casing;

a shaft disposed in the casing concentrically with the stator;

a bearing rotatably supporting the shaft for undergoing rotation relative to the stator in a preselected direction of rotation;

a rotor mounted on the shaft for rotation therewith in the preselected direction of rotation;

a motor for rotationally driving the shaft; and a flange connected to the casing at the gas inlet port, the flange having a plurality of mounting holes each for receiving a fastener and a buffering portion for undergoing deformation due to a shock resulting from a torque acting on the casing in the preselected direction of rotation, the buffering portion having a plurality of deformable thin-wall portions disposed adjacent to the respective mounting holes in a direction opposite to the preselected direction of rotation.

2. A molecular pump according to claim 1; wherein each of the thin-wall portions has a cutout section formed in an axial direction of the corresponding adjacent mounting hole.

3. A molecular pump according to claim 1; wherein the flange has a plurality of through-holes spaced apart from the respective mounting holes in a direction opposite to the preselected direction of rotation of the rotor and with the respective thin-wall portions disposed therebetween.

4. A molecular pump according to claim 3; wherein each of the mounting holes has a guiding portion for guiding a fastener inserted through the mounting hole toward a center of the corresponding thin-wall portion.

5. A molecular pump according to claim 4; wherein each of the thin-wall portions has a plastic deformation strength lower than a rupture strength of the fastener inserted through each of the mounting holes.

6. A molecular pump according to claim 5; further comprising a plurality of washers interposed between the flange and the respective fasteners, each of the washers having a portion disposed in contact with the flange and extending between a center of the corresponding fastener and an end of the washer for supporting the corresponding fastener when the corresponding fastener moves in a direction toward the corresponding thin-wall portion due to a shock resulting from a torque acting on the casing in the rotation direction of said rotor.

7. A molecular pump according to claim 4; further comprising a plurality of washers interposed between the flange and the respective fasteners, each of the washers having a portion disposed in contact with the flange and extending between a center of the corresponding fastener and an end of the washer for supporting the corresponding fastener when the corresponding fastener moves in a direction toward the corresponding thin-wall portion due to a shock resulting from a torque acting on the casing in the rotation direction of said rotor.

8. A molecular pump according to claim 3; wherein each of the thin-wall portions has a plastic deformation strength lower than a rupture strength of a fastener inserted through each of the mounting holes.

9. A molecular pump according to claim 8; further comprising a plurality of washers interposed between the flange and the respective fasteners, each of the washers having a portion disposed in contact with the flange and extending between a center of the corresponding fastener and an end of the washer for supporting the corresponding fastener when the corresponding fastener moves in a direction toward the corresponding thin-wall portion due to a shock resulting from a torque acting on the casing in the rotation direction of said rotor.

10. A molecular pump according to claim 3; further comprising a plurality of washers interposed between the flange and the respective fasteners, each of the washers having a portion disposed in contact with the flange and extending between a center of the corresponding fastener and an end of the washer for supporting the corresponding fastener when the corresponding fastener moves in a direction toward the corresponding thin-wall portion due to a shock resulting from a torque acting on the casing in the rotation direction of said rotor.

11. A molecular pump according to claim 3; wherein each of the thin-wall portions is generally plate-shaped.

12. A molecular pump comprising:

a casing having a gas inlet port and a gas discharge port;

a stator disposed within the casing;

a shaft disposed in the casing concentrically with the stator;

a bearing rotatably supporting the shaft for undergoing rotation relative to the stator in a preselected direction of rotation;

a rotor mounted on the shaft for rotation therewith in the preselected direction of rotation;

a motor for rotationally driving the shaft; and a flange connected to the casing at the gas inlet port, the flange having a buffering portion for undergoing deformation due to a shock resulting from a torque acting on the casing in the rotation direction of said rotor, the buffering portion comprising a section of the flange having an elongated hole having a width in the radial direction of the rotor and which varies along the preselected direction of rotation of the rotor.

13. A molecular pump according to claim 12; wherein the elongated hole has a positioning portion for positioning a bolt.

14. In combination with a molecular pump comprised of a casing having a gas inlet port and a rotor mounted in the casing for undergoing rotation in a preselected direction of rotation, a flange for connecting the gas inlet port of the molecular pump to an evacuating port of a vacuum vessel, the flange comprising:

a plurality of mounting holes each for receiving a fastener for connecting the flange to the vacuum vessel; and a plurality of deformable thin-wall portion disposed adjacent to the respective mounting holes in a direction opposite to the preselected direction of rotation of the rotor for undergoing deformation due to a shock resulting from a torque acting on the casing in the preselected direction of rotation.

15. A molecular pump comprising:

a casing having a gas inlet port and a gas discharge port;

a stator disposed within the casing;

a shaft disposed in the casing concentrically with the stator;

a bearing rotatably supporting the shaft for undergoing rotation relative to the stator in a preselected direction of rotation;

a rotor mounted on the shaft for rotation therewith in the preselected direction of rotation;

a motor for rotationally driving the shaft; and a flange connected to the casing at the gas inlet port, the flange having at least one mounting hole for receiving a fastener, a first elongated through-hole disposed in communication with the mounting hole, and a second elongated through-hole spaced apart from the first elongated through-hole in a direction toward a direction of rotation opposite to the preselected direction of rotation to define between the first and second elongated through-holes a deformable thin-wall portion for undergoing deformation due to a shock resulting from a torque acting on the casing in the preselected direction of rotation.

16. A molecular pump according to claim 15; wherein the at least one mounting hole comprises a plurality of mounting holes each for receiving a fastener; and further comprising a plurality of the first elongated through-holes disposed in communication with the respective mounting holes, and a plurality of the second elongated through-holes spaced apart from the respective first elongated through-holes in a direction toward a direction of rotation opposite to the preselected direction of rotation to define between each of the spaced apart first and second elongated through-holes a deformable thin-wall portion for undergoing deformation due to a shock resulting from a torque acting on the casing in the preselected direction of rotation.

17. A molecular pump according to claim 16; wherein the flange has a plurality of guiding portions each for guiding a fastener inserted in a respective one of the mounting holes toward a center of the corresponding thin-wall portion during a shock resulting from a torque acting on the casing in the preselected direction of rotation.

18. A molecular pump according to claim 17; wherein each of the guiding portions comprises a gap extending in a radial direction of the flange and having a width equal to or larger than an outer diameter of a fastener inserted in the corresponding mounting hole and smaller than an inner diameter of the corresponding mounting hole.

19. A molecular pump according to claim 18; wherein the first and second elongated through-holes are generally parallel to one another.

20. A molecular pump according to claim 15; wherein the first and second elongated through-holes are generally parallel to one another.

* * * * *

UNITED STATES PATENT AND TRADEMARK OFFICE

CERTIFICATE OF CORRECTION

PATENT NO. : 7,059,823 B2
APPLICATION NO. : 10/685713
DATED : June 13, 2006
INVENTOR(S) : Yoshiyuki Sakaguchi et al.

It is certified that error appears in the above-identified patent and that said Letters Patent is hereby corrected as shown below:

In the drawings, Sheet 2, Fig. 2, the reference numeral 17 should be deleted.

In the drawings, Sheet 9, Fig. 15, the reference numeral 104 should be replaced with the reference numeral 109.

Signed and Sealed this

Thirteenth Day of November, 2007

JON W. DUDAS
*Director of the United States Patent and Trademark Office*